US005187887A

United States Patent [19]

Mori et al.

[11] Patent Number: 5,187,887

[45] Date of Patent: Feb. 23, 1993

[54] ELECTRIC WIRE IDENTIFYING TAB AND A BAND THEREOF

[75] Inventors: Katsuhisa Mori, Osaka; Keiji Sonoda, Nara; Hideo Miyata, Neyagawashi; Yukinobu Okazaki, Daitoshi, all of Japan

[73] Assignee: Nichifu Terminal Manufacture Co., Ltd., Osaka, Japan

[21] Appl. No.: 641,134

[22] Filed: Jan. 15, 1991

[30] Foreign Application Priority Data

| | | | |
|---|---|---|---|
| Jan. 30, 1990 | [JP] | Japan | 2-8285 [U] |
| Jan. 30, 1990 | [JP] | Japan | 2-8286 [U] |
| Feb. 2, 1990 | [JP] | Japan | 2-9903 [U] |
| Feb. 7, 1990 | [JP] | Japan | 2-11200 [U] |
| Mar. 1, 1990 | [JP] | Japan | 2-21040 [U] |
| May 25, 1990 | [JP] | Japan | 2-54549 [U] |

[51] Int. Cl.[5] ..... G09F 3/00

[52] U.S. Cl. ..... 40/316; 439/491

[58] Field of Search ..... 40/316, 658; 439/488, 439/491; 174/112; D8/357

[56] References Cited

U.S. PATENT DOCUMENTS

| | | | |
|---|---|---|---|
| D. 129,913 | 10/1941 | Anderson | D8/356 |
| 1,298,981 | 4/1919 | Loughridge | 40/316 |
| 1,540,320 | 6/1925 | Everett et al. | 40/316 |
| 2,043,919 | 6/1936 | Bengton | 40/316 |
| 4,876,810 | 10/1989 | Piana et al. | 40/316 |

FOREIGN PATENT DOCUMENTS

| | | | |
|---|---|---|---|
| 674239 | 11/1963 | Canada | 40/316 |
| 78731 | 7/1963 | France . | |
| 629217 | 9/1949 | United Kingdom | 40/316 |
| 722128 | 1/1955 | United Kingdom | 40/316 |
| 750670 | 6/1956 | United Kingdom | 40/316 |
| 833292 | 4/1960 | United Kingdom | 40/316 |

*Primary Examiner*—Kenneth J. Dorner
*Assistant Examiner*—Cassandra Hope
*Attorney, Agent, or Firm*—Edwin E. Greigg; Ronald E. Greigg

[57] ABSTRACT

An electric wire-identifying tab comprises a flat main plate made of plastics, a pair of flexible lugs protruding from the main plate and of a shape adapted to grip a wire end, a clearance formed between edges of the lugs, the edges extending parallel with the main plate, and an extensive cutout formed at an end portion of the clearance, the cutout guiding juxtaposed edges of tab-mounting holders in an apparatus constructed to automatically attach the tabs on the wire ends. A continuous band comprises a plurality of the wire-identifying tabs which are connected together by joining portions so that the band is fed continuously to the apparatus.

6 Claims, 7 Drawing Sheets

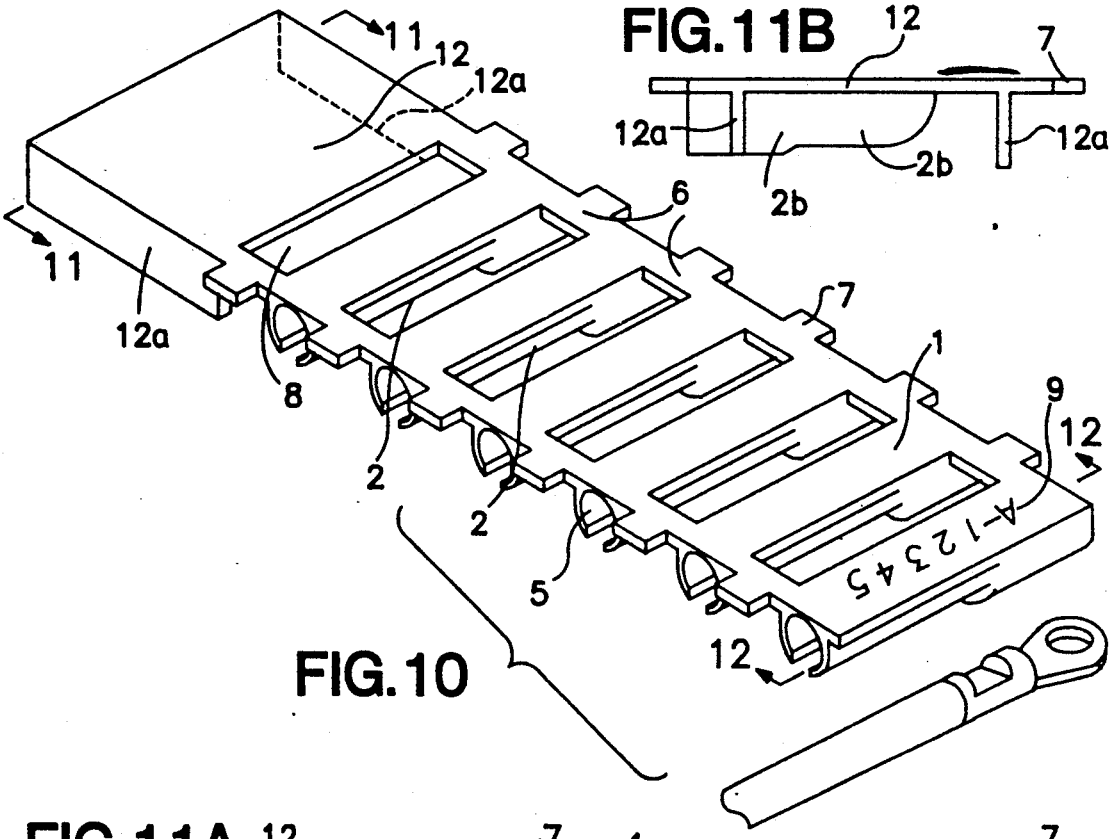
FIG. 10
FIG. 11B
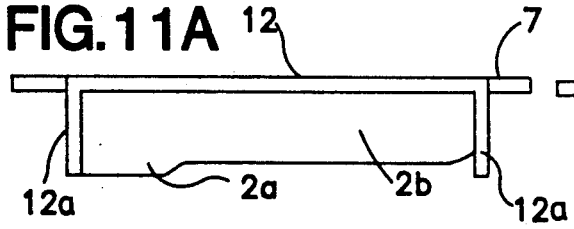
FIG. 11A
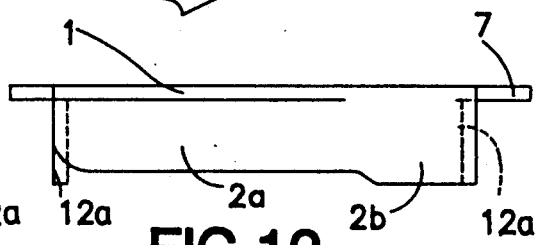
FIG. 12
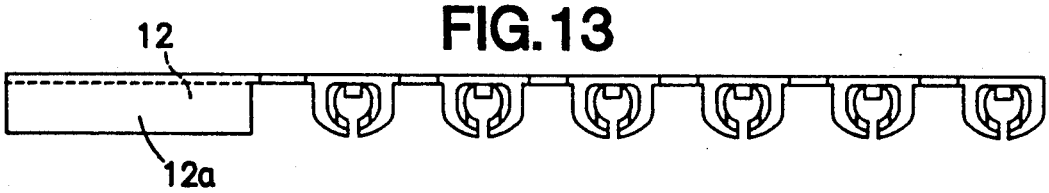
FIG. 13
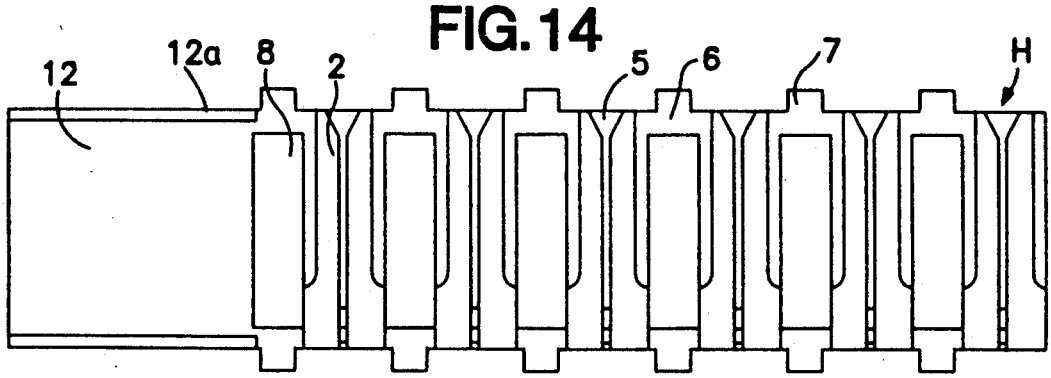
FIG. 14

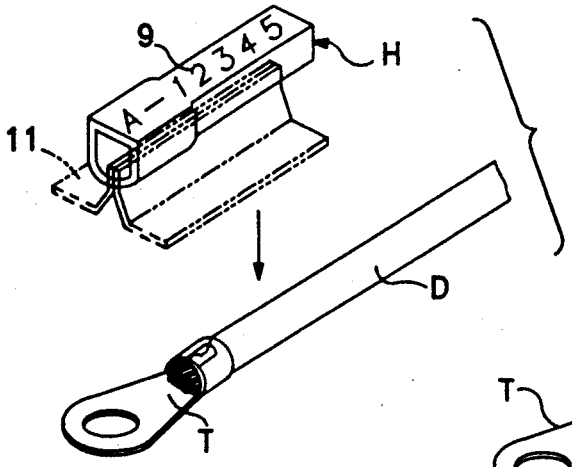
FIG.15F
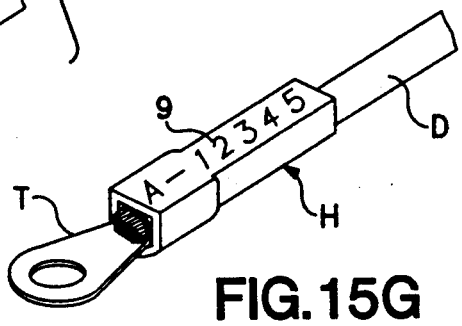
FIG.15G
FIG.16A
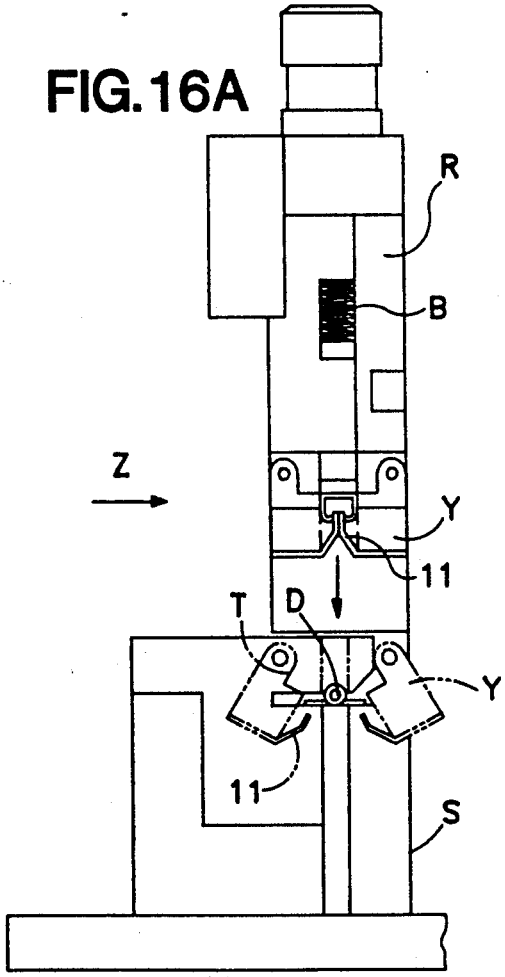
FIG.16B
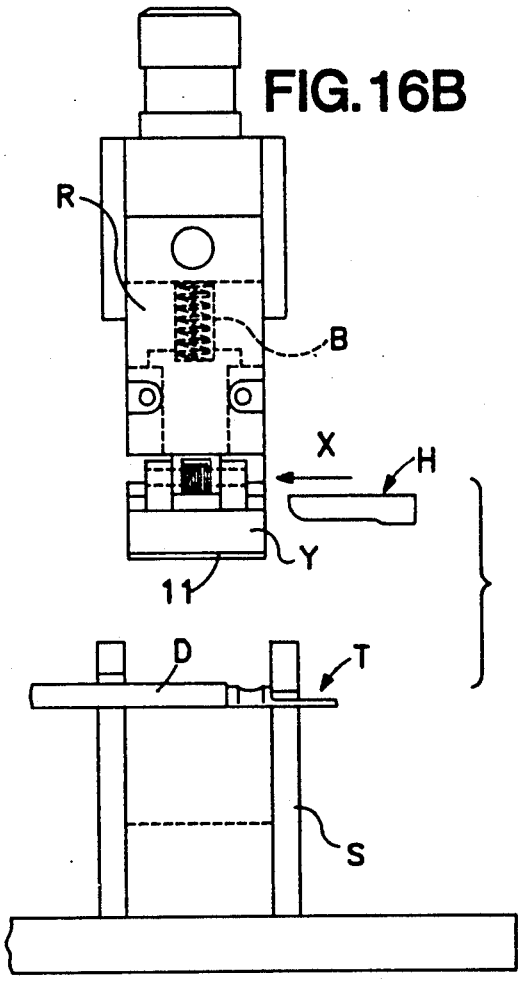

ELECTRIC WIRE IDENTIFYING TAB AND A BAND THEREOF

BACKGROUND OF THE INVENTION

1. Field of the Invention

The invention relates to an electric wire-identifying tab and a band of such tabs connected integral with one another wherein each tab is to be attached to an electric wire end by a tab-attaching operation which is conducted in connection with or independently upon a contact-crimping operation, before or after the contact-crimping operation in which operation conductive crimp contacts are separated one by one from a continuous band thereof so as to be crimped on the electric wire ends in a consecutive manner.

2. Description of Prior Art

It is a widespread practice in the wiring technique to electrically connect respectively to a pair of connectors two pluralities of electric wires each having attached thereon a conductive terminal or contact. A male-plug connector in the pair is inserted in and removed from a female-socket connector in said pair so that one plurality of electric wires are simultaneously connected to or disconnected from the other plurality of wires. There are also other cases wherein many electric wire ends are to be connected to corresponding terminals in an intricate manner. Therefore, proper markings as identifying means have widely been applied to the respective wire ends in order to prevent errors from taking place in connecting the electric wire ends. Such a marking operation has been conducted almost manually even though an enormous number of wire ends were involved, thereby making the operation complicated and unefficient.

The present applicant has, in view of such a circumstance, filed a Patent Application on Dec. 29, 1989 for the preceding invention entitled "Method for Attaching Tabs to Electric Wire Ends and an Apparatus Used in the Method".

SUMMARY OF THE INVENTION

An object of the present invention is therefore to provide an electric wire-identifying tab for use in the method and apparatus proposed by the preceding invention.

In particular, a further object of the present invention is to provide an electric wire-identifying tab and a continuous band comprising such wire-identifying tabs which each has a main plate and a pair of lugs protruding therefrom, with the lugs being of a shape adapted to grip a wire end and having a clearance between edges of the lugs, wherein the clearance allows a pair of aligned ends of the tab-mounting expansible holders (i.e., thin rigid sheets) 11 and 11 in the preceding invention to be easily and readily inserted in between the lugs.

In order to achieve the objects, the electric wire-identifying tab comprises a flat main plate made of a flexible plastics, a pair of lugs each having a cross-sectional inner surface shape of partial arc, the lugs protruding parallel with each other from a proximity of side edges of a back surface of the main plate, with the lugs having edges disposed substantially parallel with each other and with the main plate, a clearance formed between the edges of the lugs and reversibly expansible, and a tapered expansive cutout region formed at an end portion of the clearance in a manner such that a distance between the edges of the lugs gradually decreases towards the end portion.

The pair of lugs having inner surface shape of partial arc and protruding from the back side of the main plate to whose front surface the marking is to be printed, attached with an adhesive, engraved or otherwise applied may extend over the full length. Alternatively, the lugs may extend a distance corresponding to a half of the full length or less than or more than it.

To facilitate the feeding of such wire-identifying tabs to the apparatus in the preceding patent application by the present applicant, a plurality of the tabs may be arranged parallel with one another and united by joining portions to form a band. This band, as it is, may be supplied directly to the apparatus, or it may be cut into individual tabs and stacked one on another to be stored in a cartridge before the apparatus is loaded with the cartridge.

According to the present invention, the wire-identifying tab is characterized by the clearance which is as described above formed between the edges of the wire gripping lugs and shaped to be insertedly held by the ends of the tab-mounting expansible holders 11. Therefore, some principal parts or portions of the apparatus supplied with the tabs will be described in brief at first referring to FIGS. 15A to 15G.

As is shown in FIG. 15F, an electric wire end "D" which has a crimp contact "T" already crimped thereon will be laid on a wire rest "S" equipped in the apparatus as a lower part thereof. A reciprocating member "R" is disposed between a pair of guide rollers "G" so that it can be lowered towards and raised away from the wire rest. A pair of rocking arms "Y" and "Y" are pivoted to a lower portion of the reciprocating member, and are always urged to take their open positions at which they will stand spaced apart from each other. However, such a motion is restrained while the rocking arms are closed by the guide rollers "G" (as shown in FIG. 15A) and also while the juxtaposed ends of the pair of tab-mounting expansible holders 11 fixed to lower surfaces of the arms are inserted in the clearance 4 of the wire-identifying tab "H" (as shown in FIGS. 15B and 15C and described later in detail). As the reciprocating member "R" descends, the wire end "D" is forced into a gap between the holders 11, thereby the edges thereof expanding the clearance 4 of the tab "H". The electric wire end "D" will thus reach a bottom of a wire-receiving cavity of the tab "H", with reciprocating member "R" being further lowered against the elasticity of a spring "B" so as to take a position shown in FIG. 15D. At this stage, the rocking arms "Y" are released from the lugs 2 (as described in detail hereinafter) so as to be retracted sideways. Simultaneously with this motion, the lugs of the tab "H" return to their original state, with the clearance recovering its original distance. As a result, the wire-identifying tab "H" will be secured to the wire end, and the peripheral surface of thereof is thus enclosed almost completely in said tab. Then, the wire end having the tab "H" secured in this way will remain on the wire rest "S", as shown in FIG. 15G. Subsequently to this step in the process, the reciprocating member "R" starts again to move upwards and permits the wire end to be removed from this apparatus. On the other hand the guide rollers "G" restrain the rocking arms "Y" again causing them to take their closed state as shown in FIG. 15A.

The electric wire-identifying tab according to the present invention is for use in the apparatus and method in the preceding invention as summarized above. Therefore, the flat main plate made of flexible plastics possesses the pair of the lugs of the partial arc-shape, the lugs protruding integral with the main plate and in parallel with each other from the proximity of side edges of back surface of the main plate. The width of the reversibly expansible clearance formed between the edges of the lugs is made as small as possible in their unstressed normal state. To match with such a minimized width of the clearance, the width of the juxtaposed edges of the tab-mounting expansible holders 11 is also minimized correspondingly. Thus, the thin juxtaposed edges of the holders can be easily inserted into the clearance in a direction parallel with therewith, that is, in a direction perpendicular to the paper surface on which FIG. 15A is drawn. The tapered expansive cutout region formed at one end portion of the clearance has such a distance gradually decreasing towards said end portion between the edges of the lugs. This structural feature is very important because the cutout region acts as a guide to facilitate the insertion of the wire-identifying tabs into the apparatus. It is also noted that said tapered cutout region extends much shorter than the clearance and only within the one end portion of said clearance. Such a limited length of the cutout region will not impair to any significant degree the wire-identifying tab's force gripping the wire ends.

As will now be apparent, the wire-identifying tab in the invention comprises the flat main plate having the lugs configurated to enclose the wire ends, with the clearance being formed between the edges of lug to have the minimized width but with the expansive cutout provided at one end portion of said clearance. These clearance and cutout region are effective to insert easily, precisely and rapidly the pair of juxtaposed ends of the tab-mounting expansible holders 11 into each tab. On the other hand, such a simple structure merely comprising the main plate and the lugs protruding from the back surfaces thereof does make it easy to manufacture the tabs, which tabs can be surely and efficiently attached to the wire ends after the markings have been applied to the front surfaces of main plates so as to identify the individual electric wires arranged intertwiningly.

BRIEF DESCRIPTION OF THE DRAWINGS

The present invention will be described in detail referring to embodiments illustrated in the drawings, in which:

FIG. 10 is a perspective view showing a still further modification of the first embodiment;

FIG. 11A is a cross-sectional view taken along the line 11—11 in FIG. 10;

FIG. 11B is also a cross-sectional view showing a yet further modification, in a manner corresponding to FIG. 11A;

FIG. 12 is a side elevation, seen in the arrowed direction 12—12 in FIG. 10, of the still further modification;

FIG. 13 is a front elevation of the still further modification;

FIG. 14 is similarly a plan view thereof;

FIGS. 15E and 15G are perspective views showing the relationship between the tab and the wire end in the process referred to above;

FIGS. 16A and 16B are a plan view and a side elevation, respectively, showing an apparatus by which the process is carried out;

DETAILED DESCRIPTION OF PREFERRED EMBODIMENTS

Figure 1:
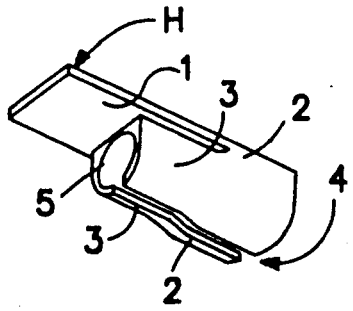
FIG. 1 is a perspective view showing a back side of a wire-identifying tab in a first embodiment.

In a first embodiment shown in FIGS. 1 to 4, a wire end-identifying tab "H" made of polypropylene by the method of injection molding comprises a flat main plate 1. The main plate 1 has a back surface from which a pair of lugs 2 protrudes integral with proximities of both edges of the back surface. Inner surfaces of the lugs 2 are of a shape of partial arc. Edges 3 of the lugs face one another and run parallel with each other and also substantially parallel with the main plate 1. A clearance 4 is formed between the edges 3, with an expansive cutout region 5 disposed at one end portion of said clearance. Within the cutout 5, the edges 3 are tapered to be apart from each other more and more towards the one end portion of the clearance 4, to thereby gradually increase a distance between them.

Figure 2:
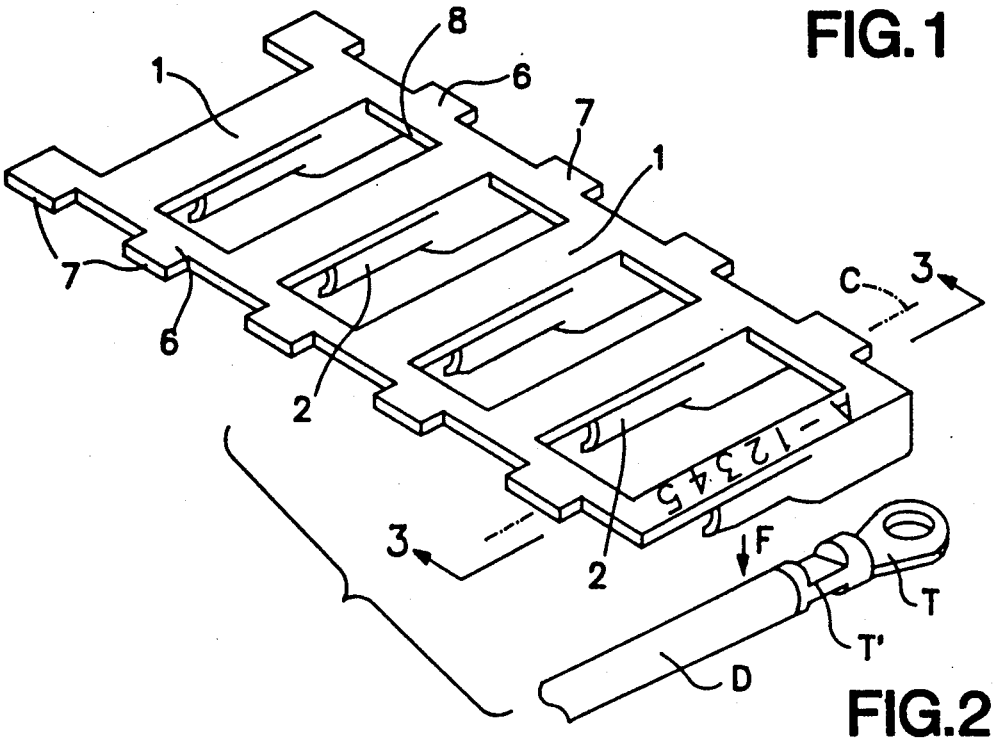
FIG. 2 is also a perspective view showing a front side of a continuous band comprising a united plurality of the wire-identifying tabs in the first embodiment.
Figure 3:
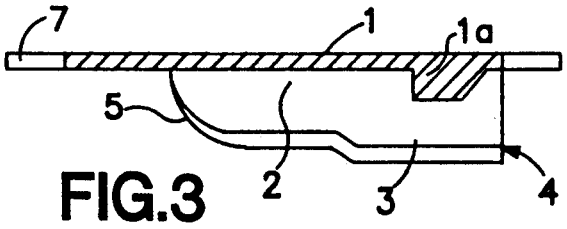
FIG. 3 is a cross-sectional view taken along the line 3—3 in FIG. 2.
Figure 4:
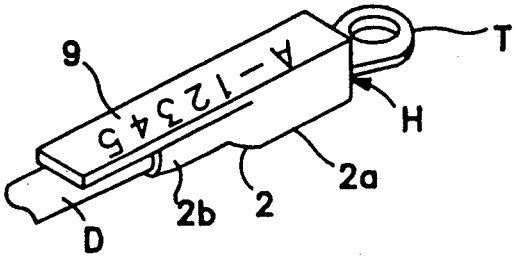
FIG. 4 illustrates the wire-identifying tab attached to an electric wire end.
Figure 15A:
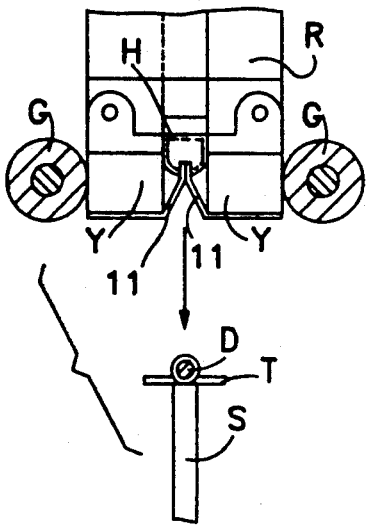
FIGS. 15A to 15E are front elevational schemes respectively illustrating such steps as included in a process for using the wire-identifying tab.
Figure 15B:
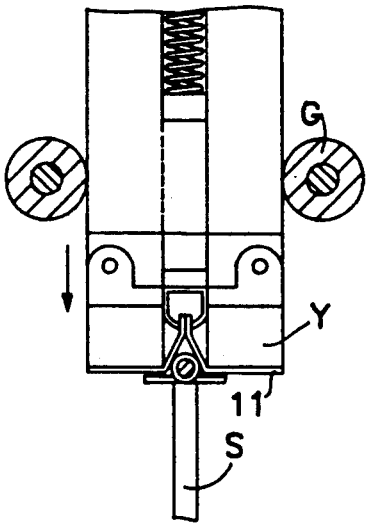
Figure 15C:
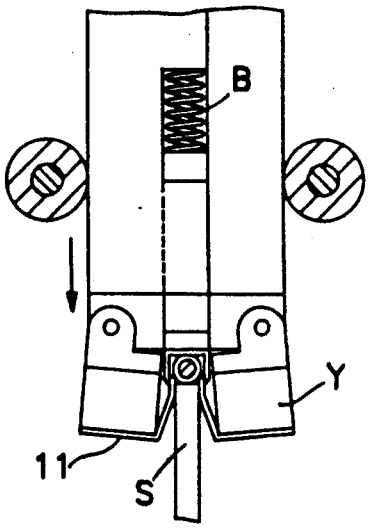
Figure 15D:
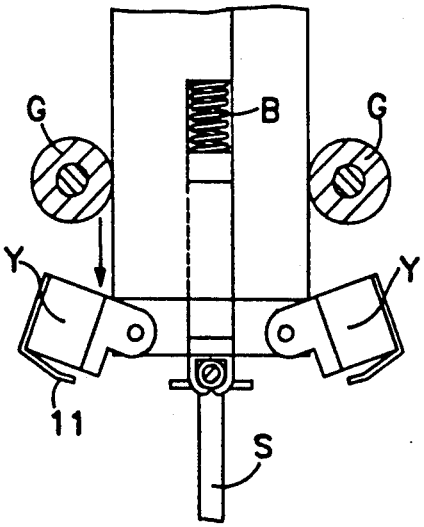
Figure 15E:
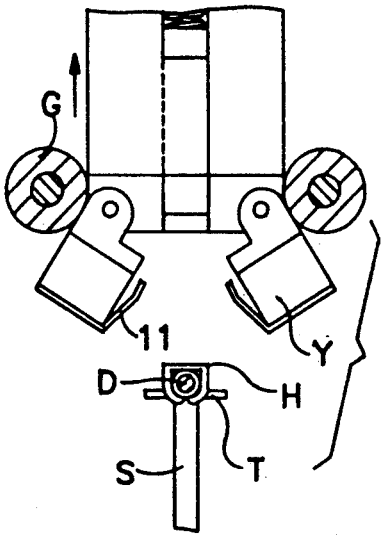
Figure 17:
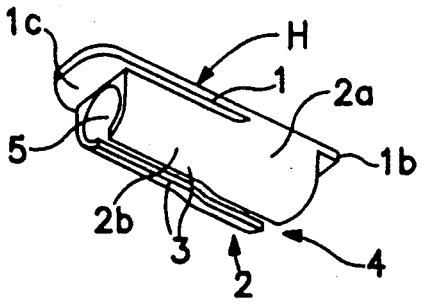
FIG. 17 is a perspective view showing a back side of a wire-identifying tab in a second embodiment.
Figure 18:
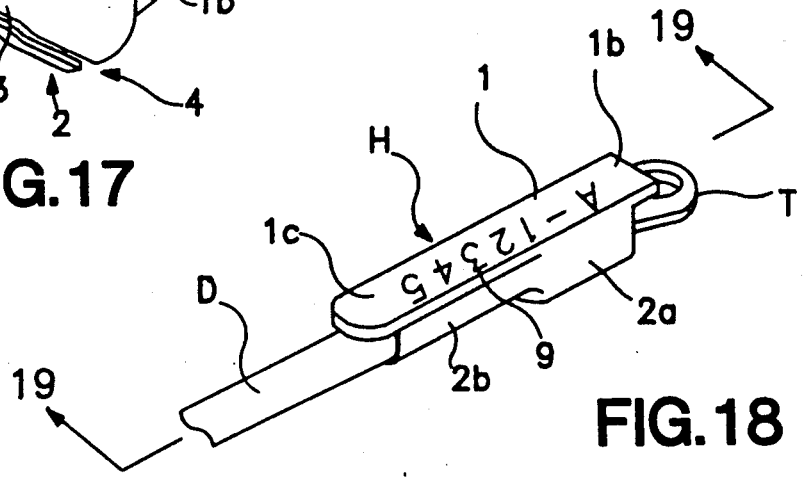
FIG. 18 illustrates the wire-identifying tab attached to an electric wire end, in the second embodiment.
Figure 19:
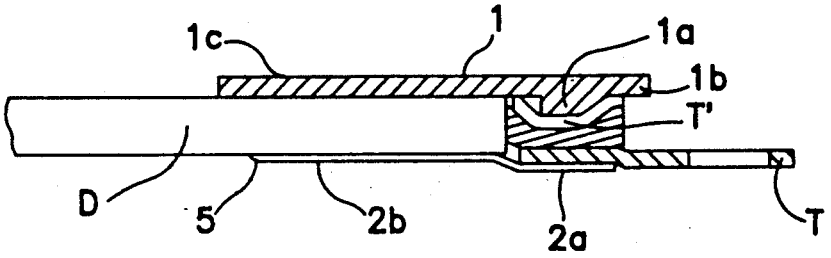
FIG. 19 is a cross section taken along the line 19—19 in FIG. 18.

As shown in FIG. 2, a plurality of the "H" are united into a band in which they are disposed parallel and connected together with interposed joining portions 6. The joining portions 6 are integral with the extremities of the tabs. Such a continuous band is to be loaded on an apparatus shown in FIG. 16A in an arrowed direction "Z". In a process for loading the band, an appropriate marking 9 will be applied at first to the front surface of the main plate 1. Subsequently the tabs are separated from the band one 20 by one, by cutting the joining portions along the line C—C in FIG. 2 before each tab is inserted into the apparatus in a direction "X" shown in FIG. 16B. In detail, the tab will be fitted tightly at its clearance 4 onto juxtaposed ends of expansible holders 11 in FIG. 15F. The tapered expansive cutout region 5 located near the one end of the clearance acts as a guide in the loading process so as to facilitate and ensure the tight fitting of the tabs.

Outlines of the operations following the fitting of tabs are already described hereinbefore. The inserted tab will be forced in an arrowed direction "F" towards the wire end and attached thereto.

Tongues 7 are respectively formed integral with and protruding from outer edges of each pair of the joining portions 6 and 6 facing one another. The tongues 7 assist the band to make an exactly straight advance to the above-mentioned apparatus. Rectangular cutouts 8 each located between the paired joining portions 6 reduce on one hand the amount of material used to make the band, on the other hand make it easier to sever the tabs from the band by cutting it along the line C—C.

In the first embodiment, each lug 2 comprises a base portion 2*a* of a larger inner diameter, the base portion gradually merging into a prolonged portion 2*b* which is of a smaller inner diameter and integrally extending from the base portion. This configuration matches a contour of the electric wire end "D" having attached thereto the crimp contact "T" having a cylindrical portion T' of an outer diameter smaller than the wire end. The main plate 1 is provided on its lower, front surface with a small protrusion 1*a* shown in FIGS. 3, 9, 19 and 21–23 which fits into and engages the smaller diameter portion T' of the wire end connector. The protrusion 1*a* prevents removal of the tab from the wire end. Further in the first embodiment, the prolonged portion 2*b* of each lug extends a distance equal to about a half of "remaining" length of main plate 1, from which "remaining" length a length of the base portion 2*a* is subtracted. By virtue of such a configuration, the wire end portion adjacent to the wire-identifying tab "H" can maintain its flexibility, with the tab being securely fixed to said wire end.

Figure 5:
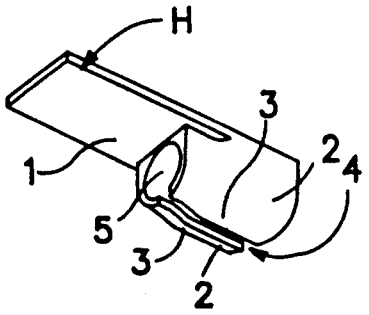
FIG. 5 is a perspective view showing a back side of the tab in an modification of the first embodiment.
Figure 6:
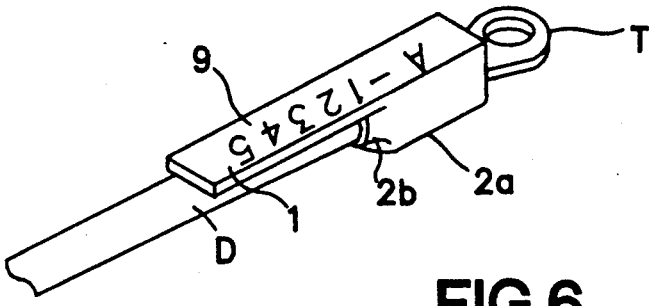
FIG. 6 is also a perspective view showing the tab attached to the wire end in the modification.

In a modification shown in FIGS. 5 and 6, the tab is of a shape such that it can be used in a case wherein the flexibility of the wire end near the tab "H" is strongly required. The prolonged portion 2*b* extends extremely short to terminate at a main plate's position corresponding to one fifth of the "remaining" length of the main plate 1. Other points are not different from those in the first embodiment.

Figure 7:
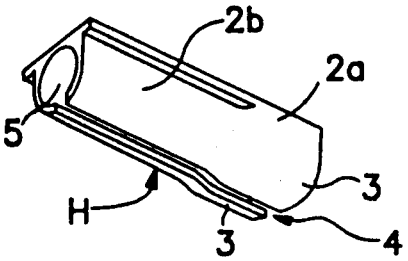
FIG. 7 a perspective view showing a back side of the tab in a further modification of the first embodiment.
Figure 8:
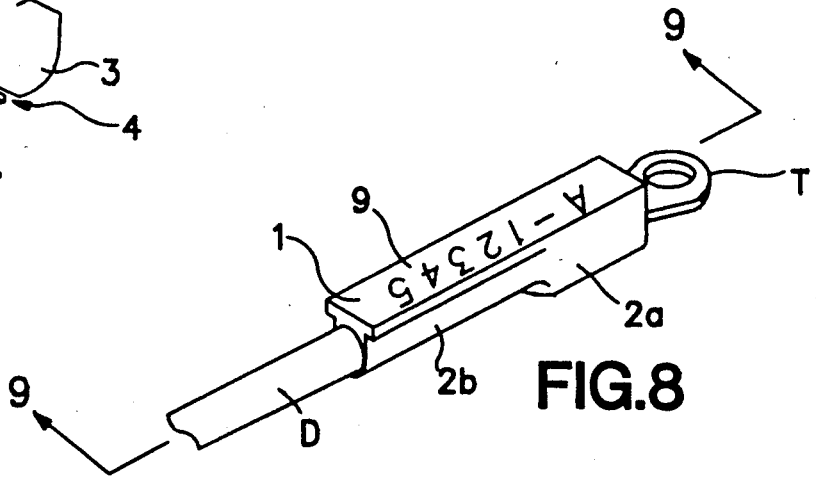
FIG. 8 is also a perspective view showing the tab attached to the wire end in the further modification.
Figure 9:
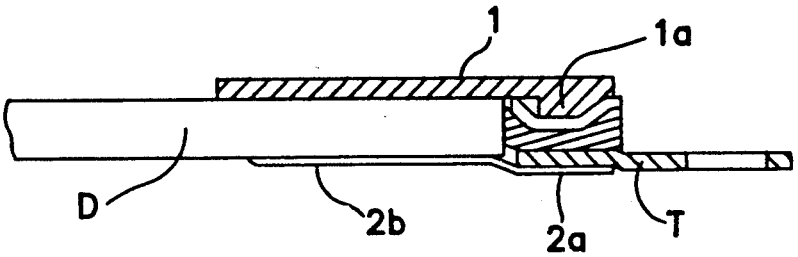
FIG. 9 is a cross-sectional view taken along the line 9—9 in FIG. 8.

In a further embodiment shown in FIGS. 7 to 9, the tab is of another shape such that it can be used in another case wherein the flexibility of the wire end is not so strongly required but the tab "H" is to be firmly secured to the wire end. Thus, the prolonged portion 2*b* in this case extends the full length of the main plate 1. Other points in the structure of the tab are however the same as the first embodiment.

Figure 20:
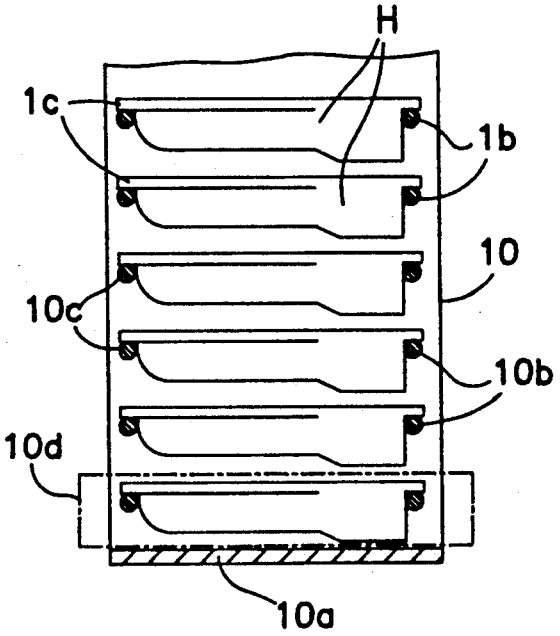
FIG. 20 is a vertical cross section showing the tabs stacked in a cartridge, in the second embodiment.

A second embodiment is illustrated in FIGS. 17 to 20 wherein extended portions 1*b* and 1*c* are integral with two opposite edges of the main plate 1 and lie in parallel therewith. These tabs will be stacked in a cartridge case 10 as is shown in FIG. 20 after the marking 9 is applied to the outer surface of each tab. The pair of right and left extended portions 1*b* and 1*c* are to be supported by lateral rods 10*b* and 10*c*, respectively, which are parallel with a bottom plate 10*a* of the cartridge. Therefore, the tabs "H" will be laid one on another parallel with each other within the cartridge. The cartridge 10 will be raised or lowered stepwise so that the wire-identifying tabs "H" are pushed outwardly of the cartridge one by one in their horizontal and longitudinal direction through an opening 10*d* of the cartridge, and in unison with the stepwise movement thereof. The extended portions 1*b* and 1*c* of the thus pushed tabs "H" will slide on the lateral rods 10*b* and 10*c* so as to advance in their longitudinal direction, thereby being smoothly delivered to the tab-holding expansible holders in the above-mentioned apparatus. The opening 10*d* also mentioned above is a hole penetrating an outside housing (not shown) which encloses the cartridge.

The extended portions may be formed with a difference in level between the main plate and them so that they are positioned at a main plate's side opposite to its another side from which the lugs protrude. This configuration is advantageous in that the tabs can be held not to tumble in their longitudinal direction within the cartridge even if the lugs were formed short in the sense referred to hereinbefore.

The wire-identifying tabs may either be formed individually or be formed as a continuous band thereof and separated thereafter into individual tabs.

Figure 21:
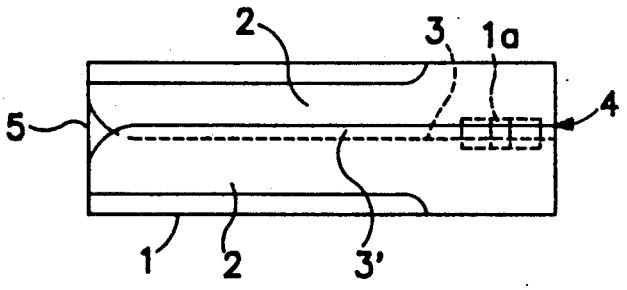
FIG. 21 is a bottom view of a wire-identifying tab in a third embodiment.
Figure 22:
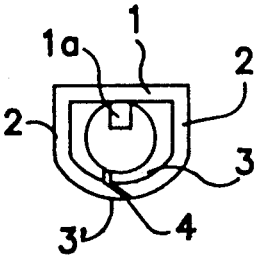
FIG. 22 is a right-hand side elevation showing the tab in the third embodiment.
Figure 23:
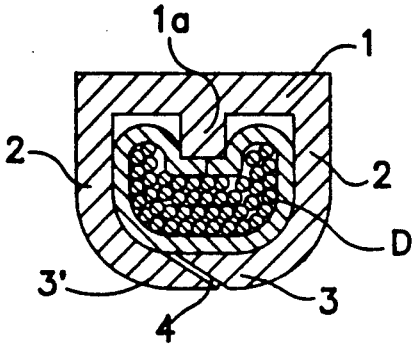
FIG. 23 illustrates the wire-identifying tab attached to an electric wire end, in the third embodiment.

FIGS. 21 to 23 shows a third embodiment in which a pair of lugs 2 each composed of a base portion 2*a* and an extended portion 2*b* protrude from a back surface of a main plate 1. The lugs extend parallel with each other, and their extremities or edges 3 and 3' are substantially parallel with each other and with the main plate. A clearance 4 is provided between the extremities 3 and 3', and is expansible with respect to its width similarly to the foregoing embodiments. However, in this third embodiment, one of the extremities 3 is positioned inside the other extremity 3'. Though the clearance 4 is not perpendicular to but oblique to the surface of the main plate 1, a tapered extensive cutout 5 formed between one end portions of the lugs will perform as a guide which assists the tab to be inserted without any difficulty into the apparatus mentioned above. Once the tab is attached to the wire end, any surface portion thereof cannot be seen from the outside, thus improving the aesthetic effect of the wire-identifying tab. In addition, such a complete enclosure with the tab is also desirable in view of protection of operators' fingers from electric shock and protection of any conductive objects from the accident of short circuit.

Figure 24:
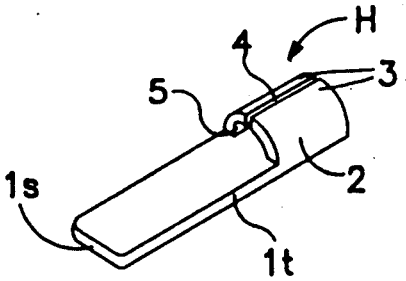
FIG. 24 is a perspective view showing a back side of a wire-identifying tab in a fourth embodiment.
Figure 25:
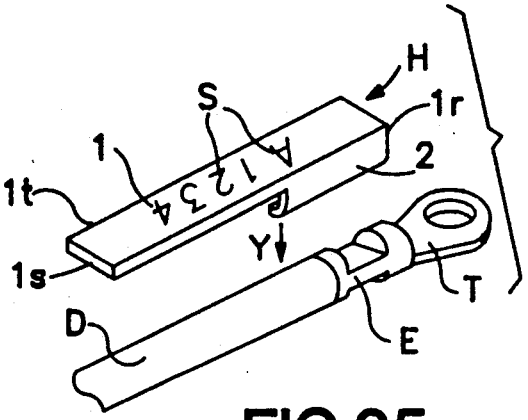
FIG. 25 illustrates the wire-identifying tab which is being attached to an electric wire end, in the fourth embodiment.
Figure 26:
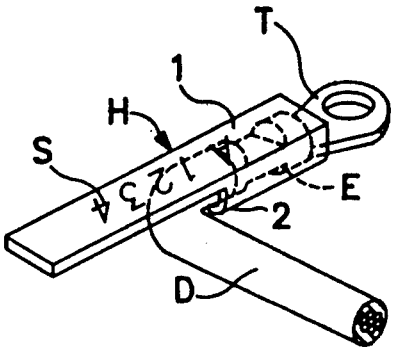
FIG. 26 is a perspective view showing a bent state of the wire end to which the tab has been attached, in the fourth embodiment.

A fourth embodiment shown in FIGS. 24 to 26 provides a wire-identifying tab which comprises lugs 2 each shaped uniform without any divisional portions such as the base portion 2*a* and the extended portion 2*b* involved in the foregoing embodiments. Each lug 2 in the fourth embodiment extends from one of shorter sides 1*r* of the rectangular main plate 1 towards the other shorter side 1*s*, and terminates short of a middle point of longer sides 1*t*. Thus, the lugs 2 are of such a longitudinal size as only covering the conductive sleeve E of crimp contact. Accordingly, a wire end portion not enclosed in the lugs as shown in FIG. 26 can be flexed very easily in any direction and to any degree of angle. This feature is more advantageous than the above embodiments in handling the wire ends having the tabs and also in handling any electric devices to which wires are connected.

In a still further modification shown in FIGS. 10 to 14, a belt-like extension 12 protrudes from the extreme end of a continuous band of the predetermined number of tabs "H". The extension 12 is added to the outermost tab by the joining portions 6 so that the outermost tab and other trailing tabs adjacent thereto can be fed to the apparatus in the arrowed direction "Z" in FIG. 16A, under the same condition as the other leading tabs. Width of the extension 12 is the same as the length of each wire-identifying tab "H". Upright bent-up tags 12*a* of the same height as the lugs 2 may protrude from side edges of the extension as shown in FIG. 11A. Alternatively, the tags 12*a* may extend from portions near said side edges of the extension 12, for example from such portions aligned with the shorter sides of the rectangular cutouts 8 as shown in FIG. 11B whereby the position of the band becomes more stable when transported. Thus it is possible in this modification that the band is protected from rocking vertically or horizontally and held stably within a transporting device supplying the tabs to the apparatus mentioned above even when the outermost tab or the tabs adjacent thereto are severed from the band. Other features in this modification are the same as those in the first embodiment.

The wire-identifying tab may be further modified within the scope of the present invention. The partial arc-shaped lug 2 may have uniform inner and outer diameters over the full length. The tab may be of a shape adapted for use with a crimp contact which has a conductive sleeve covered by a plastics tube wherein the tab will enclose only a bare cable end uncovered by the sleeve. Furthermore, the tapered expansive cutout may be provided at both ends of the clearance so that the tab can be mounted to the juxtaposed ends of the tab-mounting holder, from either side of the tab, in the apparatus according to the preceding patent application by the present applicant.

What is claimed is:

1. A band of electric wire-identifying tabs (H) each comprising a flat main plate (1) made of a flexible plastic and having a front surface, a back surface, a front end and an aft end, a pair of expansible lugs (2) each having a cross-sectional inner surface shape of a partial arc, the lugs (2) protruding parallel with each other from opposite sides of the back surface of the main plate, the lugs having edges (3) disposed substantially parallel with each other and with the back surface of the main plate (1), a clearance (4) formed between the edges (3), and a tapered expansive cutout region (5) formed at the aft end of the clearance (4) in a manner such that a distance between the edges (3) of the lugs gradually decreases toward a front end portion, and the band comprising joining portions (6) each being integral with and connecting two adjacent wire-identifying tabs (H) in parallel with each other, said band further comprising tongues (7) protruding from outer edges of the joining portions (6).

2. A band of electric wire-identifying tabs in accordance with claim 8, further comprising a belt-like extension (12) added to an outermost tab (H) by the joining portion (6) wherein a width of the extension (12) is the same as a length of the tabs (H), and upright bent-up tags (12*a*) extend from opposite sides of a surface of the extension, the tags (12*a*) extending from the same surface of the band as the lugs (2) and being of the same height as the lugs.

3. An electric wire-identifying tab as claimed in claim 1 wherein said main plate (1) is provided with a small protrusion extending from a lower end surface.

4. An electric wire-identifying tab comprising a flat main plate (1) made of flexible plastic and having a front surface, a back surface, a front end and an aft end, a pair of oppositely disposed expansible lugs (2) each having a cross-sectional inner surface having a shape of a partial arc, the lugs (2) protruding substantially parallel with each other from opposite sides of the back surface of the main plate, the lugs having first and second edges, respectively (3, 3') disposed, substantially parallel with each other, whereby said first edges is (3) cut on an angle and positioned overlapping said second edge (3'), a constrictable clearance (4) formed between the first and second edges and a tapered expansible cutout region (5) formed at an aft end portion of the lugs (2) such that the tapered expansible cutout region (5) at the aft end portion extends from the back surface of the main plate (1) downwardly and forwardly toward the constrictable clearance (4) in a manner such that a distance between the first and second edges (3, 3') of the lugs gradually decreases towards the front end portion of the first and second edges (3, 3').

5. An electric wire-identifying tab in accordance with claim 4, further comprising front and aft extended end portions (1*b*, 1*c*) protruding from and integral with the front and aft ends of the main plate (1).

6. An electric wire-identifying tab in accordance with claim 4, wherein the lugs (2) extend from the front end (1*r*) towards the aft end (1*s*) so as to terminate short of a middle point of a length of the main plate (1*t*).

* * * * *